US009634400B2

(12) United States Patent
Zelenski et al.

(10) Patent No.: US 9,634,400 B2
(45) Date of Patent: Apr. 25, 2017

(54) DISH ANTENNA HAVING A SELF-SUPPORTING SUB-REFLECTOR ASSEMBLY

(71) Applicant: Winegard Company, Burlington, IA (US)

(72) Inventors: Alexander Anatoli Zelenski, Burlington, IA (US); Brent Lee Venghaus, Mount Pleasant, IA (US)

(73) Assignee: Winegard Company, Burlington, IA (US)

( * ) Notice: Subject to any disclaimer, the term of this patent is extended or adjusted under 35 U.S.C. 154(b) by 127 days.

(21) Appl. No.: 14/504,161

(22) Filed: Oct. 1, 2014

(65) Prior Publication Data

US 2015/0091769 A1 Apr. 2, 2015

Related U.S. Application Data

(60) Provisional application No. 61/885,875, filed on Oct. 2, 2013.

(51) Int. Cl.
*H01Q 19/19* (2006.01)
*H01Q 13/02* (2006.01)
*H01Q 19/13* (2006.01)

(52) U.S. Cl.
CPC ..... *H01Q 19/193* (2013.01); *H01Q 13/02* (2013.01); *H01Q 13/0208* (2013.01); *H01Q 19/134* (2013.01)

(58) Field of Classification Search
CPC ..... H01Q 19/193; H01Q 13/02
USPC ..... 343/781 CA
See application file for complete search history.

(56) References Cited

U.S. PATENT DOCUMENTS

| | | | | |
|---|---|---|---|---|
| 3,530,480 | A | 9/1970 | Rongved et al. | |
| 3,611,391 | A | 10/1971 | Bartlett | |
| 4,673,945 | A | 6/1987 | Syrigos | |
| 4,963,878 | A | 10/1990 | Kildal | |
| 6,020,859 | A | 2/2000 | Kildal | |
| 6,137,449 | A * | 10/2000 | Kildal | H01Q 1/42 343/781 CA |
| 6,862,000 | B2 * | 3/2005 | Desargant | H01Q 19/023 343/781 CA |
| 7,907,097 | B2 | 3/2011 | Syed et al. | |
| 2002/0008670 | A1 * | 1/2002 | Sharman | H01Q 1/42 343/840 |
| 2010/0085265 | A1 * | 4/2010 | Woetzel | H01Q 19/19 343/781 CA |

(Continued)

FOREIGN PATENT DOCUMENTS

| | | |
|---|---|---|
| EP | 0102846 A1 | 3/1984 |
| EP | 1128468 A2 | 8/2001 |

*Primary Examiner* — Dameon E Levi
*Assistant Examiner* — David Lotter
(74) *Attorney, Agent, or Firm* — Dorr, Carson & Birney PC

(57) ABSTRACT

An antenna has a waveguide horn extending from a main reflector. A dielectric tube extends from the distal end of the waveguide horn to support a sub-reflector in the focal region of the main reflector. An insert is placed into the dielectric tube to seat against the distal end of the dielectric tube. A fastener secures the insert to the sub-reflector, thereby securing the sub-reflector to the distal end of the dielectric tube. The surface of the insert serves as a continuation of the sub-reflector. The dielectric tube can be equipped with an inwardly-extending collar about its distal end to engage the insert.

12 Claims, 5 Drawing Sheets

(56) References Cited

U.S. PATENT DOCUMENTS

| | | | | |
|---|---|---|---|---|
| 2013/0162492 | A1* | 6/2013 | Kishino | H01Q 19/134<br>343/781 CA |
| 2014/0247191 | A1* | 9/2014 | Mahon | H01Q 19/19<br>343/781 CA |

* cited by examiner

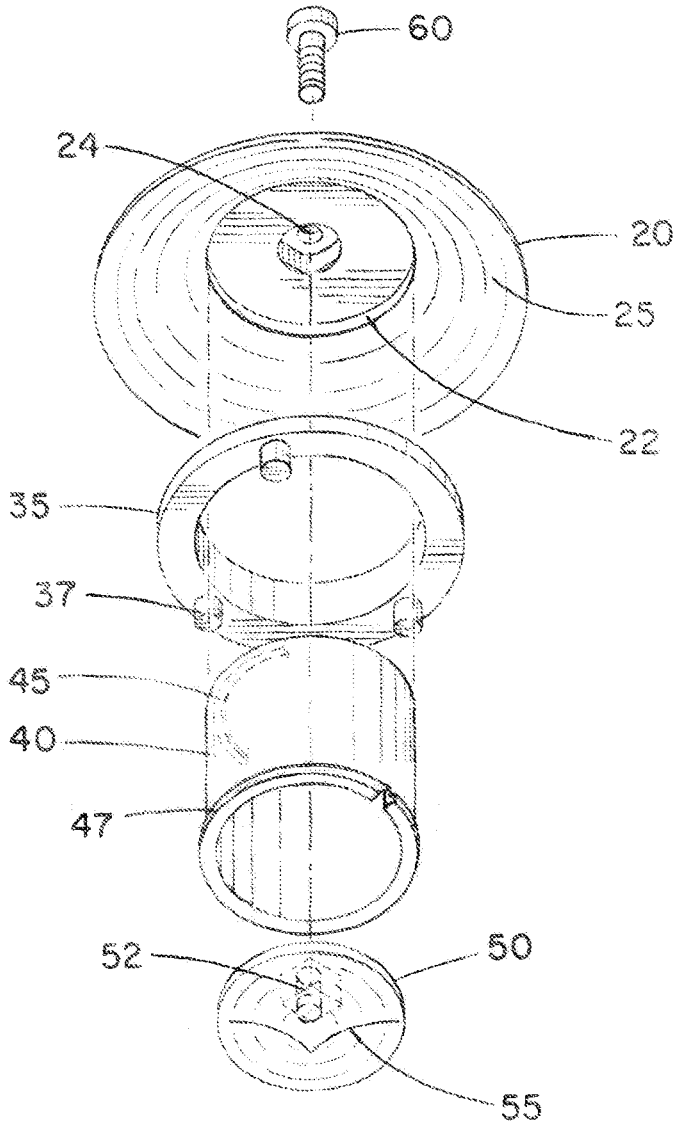
Fig. 5
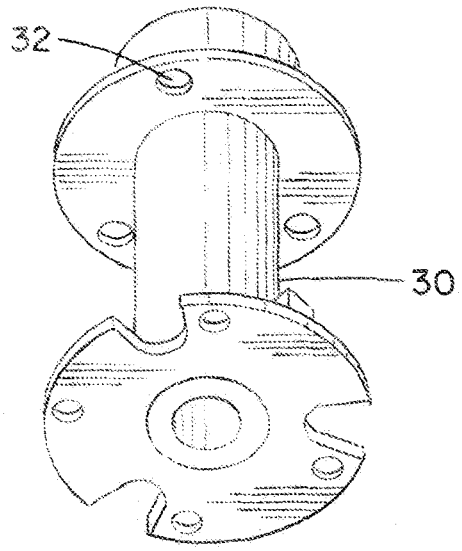

DISH ANTENNA HAVING A SELF-SUPPORTING SUB-REFLECTOR ASSEMBLY

RELATED APPLICATION

The present application is based on and claims priority to the Applicants' U.S. Provisional Patent Application 61/885,875, entitled "Ring Focus Antenna," filed on Oct. 2, 2013.

BACKGROUND OF THE INVENTION

Field of the Invention

The present invention relates generally to the field of antennas. More specifically, the present invention discloses a dish antenna with a self-supporting sub-reflector assembly suitable for use in satellite broadcasting.

Statement of the Problem

Parabolic reflector antennas are widely used in the field of satellite television broadcasting. With the improvements in receiving/transmitting equipment used on the satellites, more powerful beams are transmitted to the ground and that in turn allows the use of smaller antennas than those used before. Dual-reflector antennas occupy less volume and are preferable for use in mobile applications, such as on recreational vehicles, automobiles, small boats, or in portable antenna systems.

Many dual-reflector antennas have a primary reflector with a generally parabolic shape and a smaller sub-reflector positioned in the focal region of the primary reflector. A waveguide horn extends from the primary reflector toward the sub-reflector.

Accurate positioning of the sub-reflector with respect to the primary reflector and the waveguide horn is a major concern to ensure optimal performance of the antenna. The antenna assembly can be subject to a variety of physical forces in the field, such as wind loads, vibration and mechanical shock, that can adversely affect the positioning and relative alignment of these components. Therefore, a need exists to ensure that the mechanical structure of the reflectors and waveguide horn is relatively sturdy and robust. In addition, the cost of the required components and their simplicity of assembly during the manufacturing process is another major concern, while providing accurate initial alignment of these components. Thus, there remains a need for a dual-reflector antenna that can be easily manufactured and provides a sturdy mechanical structure to maintain proper alignment of the reflectors and waveguide horn.

The prior art in this field includes a number of dual-reflector antennas that use a dielectric tube or other member to support the sub-reflector, including U.S. Pat. No. 3,530,480 (Rongved et al.), U.S. Pat. No. 3,611,391 (Bartlett), U.S. Pat. No. 6,862,000 (Desargant et al.), U.S. Pat. No. 4,673,945 (Syrigos), and U.S. Pat. Nos. 6,137,449, 4,963,878 and 6,020,859 (Kildal). However, none of these references teach or suggest the specific structure of the present invention, in which an insert is used to secure the distal end of a dielectric tube to the sub-reflector.

SUMMARY OF THE INVENTION

The present invention provides an antenna having a waveguide horn extending from a main reflector. A dielectric tube extends from the distal end of the waveguide horn to support a sub-reflector in the focal region of the main reflector. An insert is placed into the dielectric tube to seat against the distal end of the dielectric tube. A fastener secures the insert to the sub-reflector, thereby securing the sub-reflector to the distal end of the dielectric tube. The surface of the insert serves as a continuation of the sub-reflector. The dielectric tube can be equipped with an inwardly-extending collar about its distal end to engage the insert.

These and other advantages, features, and objects of the present invention will be more readily understood in view of the following detailed description and the drawings.

BRIEF DESCRIPTION OF THE DRAWINGS

The present invention can be more readily understood in conjunction with the accompanying drawings, in which:

FIG. 5 is an exploded bottom axonometric view corresponding to FIG. 3.

DETAILED DESCRIPTION OF THE INVENTION

Figure 1:
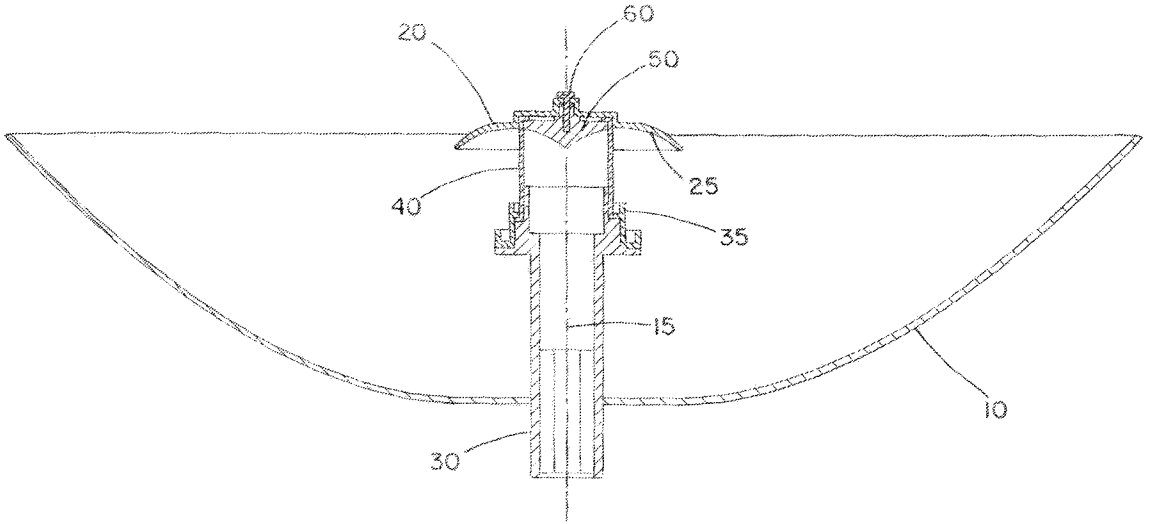
FIG. 1 is a side cross-sectional view of an embodiment of the present antenna.
Figure 2:
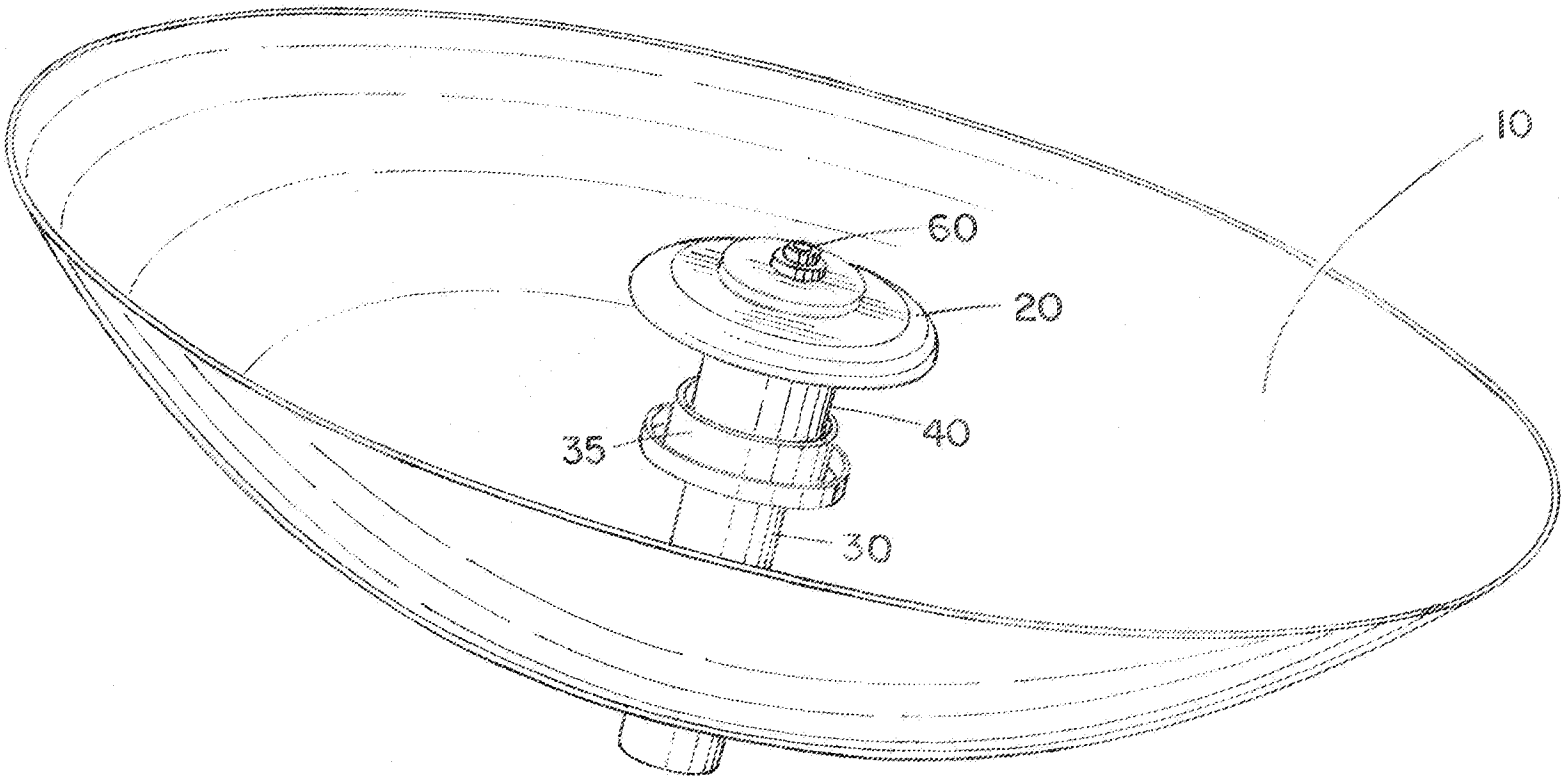
FIG. 2 is an axonometric view of the antenna corresponding to FIG. 1.

FIG. 1 is a side cross-sectional view of an embodiment of the present antenna and FIG. 2 is a corresponding axonometric view of this antenna. The major components of the present antenna include a main reflector 10, a sub-reflector 20, a waveguide horn 30 extending from the main reflector 10, and a dielectric tube 40 extending from the distal end of the waveguide horn 30 to support the sub-reflector 20. The main reflector 10 is generally concave to form a predetermined focal region. In the embodiment shown in the accompanying drawings, the main reflector 10 has a generally parabolic surface of revolution about an axis of symmetry 15 that is aligned with, or parallel to the parabola axis. Alternatively, the main reflector 10 could have any of a variety of cross-sections, including spherical or trough-shaped The feed element for the antenna assembly includes a waveguide horn 30 extending from the main reflector 10 concentric with the axis 15 of the main reflector 1. In general, all of the elements of the antenna are concentric about this common axis 15 in the embodiment shown, although this is not necessarily the case in other embodiments of the present invention.

Figure 4:
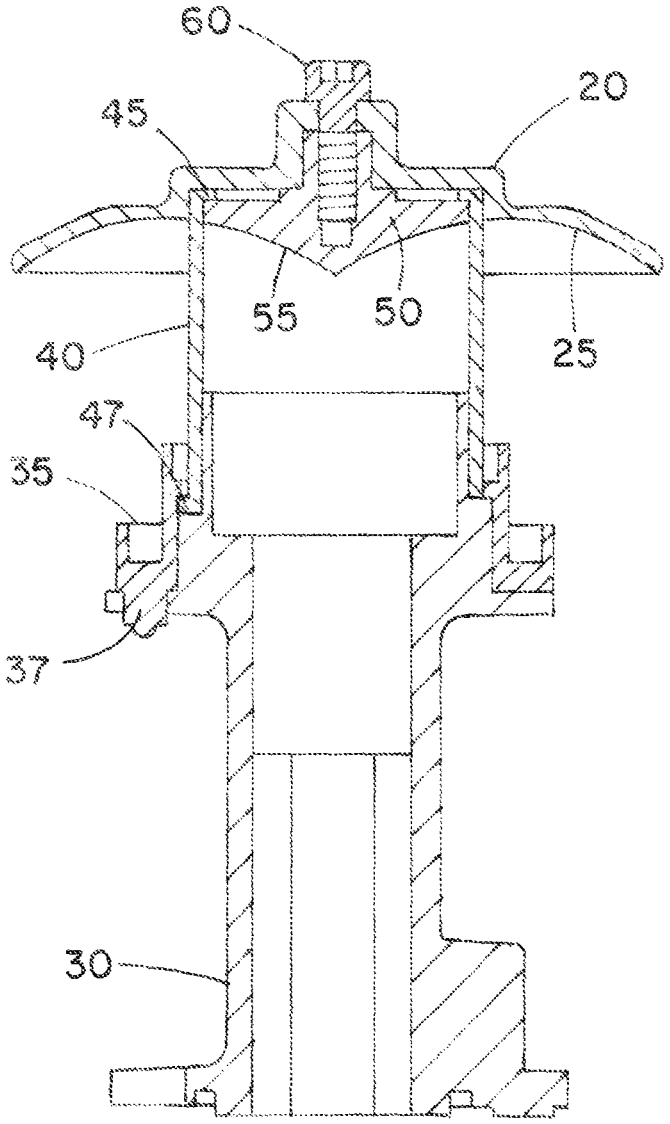
FIG. 4 is a cross-sectional view of the assembly corresponding to FIG. 3.

The sub-reflector 20 is mounted beyond the distal end of the waveguide horn 30, and is typically positioned in the focal region of the main reflector 10, so that the received signal is first reflected by the main reflector 10 onto the sub-reflector 20 and then reflected into the waveguide horn 30. The under-surface 25 of the sub-reflector 20 (i.e., the surface facing the main reflector 10) can be a radially-symmetrical contoured surface (e.g., an elliptical cross-section as shown in FIGS. 1, 4 and 5) to enhance antenna performance.

A dielectric tube 40 supports the sub-reflector 20 from the distal end of the waveguide horn 30. The dielectric tube 40 can be made of any suitable dielectric material having suitable mechanical properties, such as any of a variety of ceramics or plastics. In the preferred embodiment of the present invention shown in the drawings, a recess 22 is formed in the under-surface 25 of the sub-reflector 20 to receive the distal end of the dielectric tube 40.

An insert 50 is placed into the dielectric tube 40 to engage the distal end of the dielectric tube 40 to the sub-reflector 20. In particular, the distal end of the dielectric tube 40 can be provided with a collar 45 that extends radially inward. The insert 50 has the general shape of a circular disk with a diameter slightly less than the inside diameter of the dielectric tube 40, but larger than opening left by the collar 45. In this manner, the collar 45 can be clamped between the insert 50 and the sub-reflector 20. A fastener (e.g., a screw 60, bolt, rivet, interlocking tabs and slots, adhesive or thermal welding) can then be used to secure the insert 50 to the sub-reflector 20. In the embodiment shown in the drawings, a screw 60 is inserted through a hole 24 in the sub-reflector 20 and threaded into a corresponding hole 52 in the insert 50 to secure the insert 50 to the sub-reflector 20. Thus, the insert 50 is seated against the collar 45, and the distal end of the dielectric tube 40 is thereby clamped into the recess 22 in the sub-reflector 20.

It should be noted that the under-surface 55 of the insert 50 can function as a portion of the sub-reflector surface. In the preferred embodiment of the present invention, the depth of the recess 22 in the sub-reflector 20 and the thicknesses of the collar 45 and insert 50 are selected so that the under-surface 55 of the insert 50 after assembly is substantially a continuation of the under-surface 25 of the sub-reflector. In other words, the under-surface 55 of the insert 50 can be contoured in conjunction with the under-surface 25 of the sub-reflector 20 to provide a substantially continuous reflective surface. For example, the accompanying drawings show a sub-reflector 20 with a radial cross-section forming a portion of an ellipse that is continued by the under-surface 55 of the insert 50.

Figure 3:
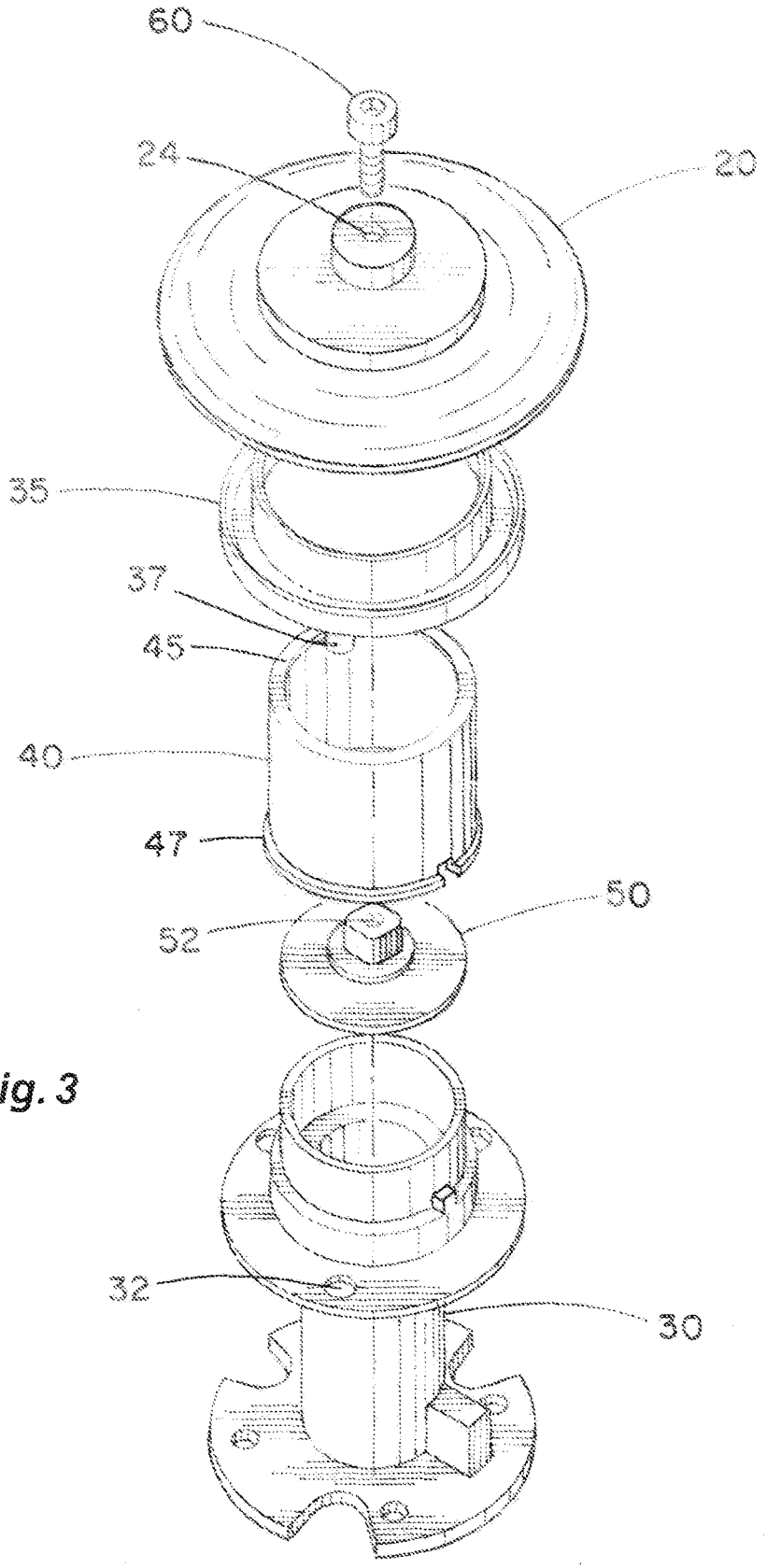
FIG. 3 is an exploded top axonometric view of the sub-reflector 20, waveguide horn 30, dielectric tube 40, insert 50 and annular ring 35.

The proximal end of the dielectric tube 40 is secured in axial alignment with the distal end of the waveguide horn 30. In one embodiment, an annular ring 35 slides over the body of the dielectric tube 40 and engages a lip or flange 47 extending outward from the proximal end of the dielectric tube 40, as shown in FIGS. 3 and 4. The annular ring 35 is then secured to the distal end of the waveguide horn 30 with the flange 47 of the dielectric tube 40 clamped in place against the waveguide horn 30, as shown in FIG. 4. The annular ring 35 can also be equipped with a number of protrusions 37 that seat in corresponding holes 32 in the distal end of the waveguide horn 30 to ensure proper alignment of the resulting assembly. Optionally, the sub-reflector 20, dielectric tube 40 and waveguide horn 30 can also be equipped with complementary sets of alignment notches and protrusions to ensure accurate alignment of these components. For example, accurate radial alignment of these components is an important consideration for embodiments having an asymmetrical main reflector 10 or sub-reflector 20.

The following is a discussion of one method of assembly of the present invention. First, the insert 50 is placed into the dielectric tube 40 through its proximal opening to contact the collar 45 at the distal end of the dielectric tube 40. The dielectric tube 40 can be provided with small tabs to hold the insert 50 in place during assembly. The annular ring 35 is then placed around the dielectric tube 40. Next, the proximal end of the dielectric tube 40 is secured to the distal end of the waveguide horn 30 by securing the annular ring 35 to the distal end of the waveguide horn 30 by a staking process or by fasteners, such as bolts or screws. The distal end of the dielectric tube 40 is then seated in the recess 22 in the sub-reflector 20. A screw 60 is inserted through the hole 24 in the sub-reflector 20 and tightened to engage the insert 50, thereby securing the dielectric tube 40 to the sub-reflector 20.

Alternatively, the insert 50 can be initially secured in place in the recess 22 in the sub-reflector 20, and the distal end of the dielectric tube 40 is then forced over the insert 50 to engage the dielectric tube 40 to the sub-reflector 20. However, this approach depends on the diameters of the insert 50 and the distal end of the dielectric tube 40, as well as generally requiring a tool to force the insert 50 into the distal end of the dielectric tube 40. Other methods of assembly could also be employed.

It should be noted that the present invention provides a number of advantages over the prior art. The antenna can be easily and rapidly assembled while maintaining a high degree of precision in alignment of the component. No glue needed. In addition, the assembled structure is very sturdy to help prevent misalignment problems in the use in the field.

The above disclosure sets forth a number of embodiments of the present invention described in detail with respect to the accompanying drawings. Those skilled in this art will appreciate that various changes, modifications, other structural arrangements, and other embodiments could be practiced under the teachings of the present invention without departing from the scope of this invention as set forth in the following claims.

We claim:

1. An antenna comprising:

a main reflector having a focal region;

a sub-reflector having an under-surface;

a waveguide horn extending from the main reflector toward the focal region and having a distal end;

a dielectric tube extending from the distal end of the waveguide horn and having a distal end supporting the sub-reflector in the focal region with the under-surface of the sub-reflector extending outward beyond the distal end of the dielectric tube, said dielectric tube having a collar extending inward about its distal end;

an insert insertable into the dielectric tube to seat against the collar of the dielectric tube and having a reflector surface; and a fastener securing the insert against the collar of the dielectric tube to the sub-reflector, thereby securing the sub-reflector to the distal end of the dielectric tube with the reflector surface of the insert continuing the under-surface of the sub-reflector.

2. The antenna of claim 1 wherein the dielectric tube comprises ceramic.

3. The antenna of claim 1 wherein the dielectric tube comprises plastic.

4. The antenna of claim 1 wherein the fastener comprises a screw extending through the sub-reflector and engaging the insert.

5. The antenna of claim 1 wherein the sub-reflector further comprises a recess for receiving the distal end of the dielectric tube and the insert.

6. The antenna of claim 1 wherein the dielectric tube further comprises a flange extending outward about its proximal end, and further comprising an annular ring fitting over the dielectric tube and engaging the flange to the distal end of the waveguide horn.

7. An antenna comprising:

a main reflector having a focal region;

a sub-reflector having an under-surface and a recess in the under-surface;

a waveguide horn extending from the main reflector toward the focal region and having a distal end;

a dielectric tube extending from the distal end of the waveguide horn and having a distal end insertable into the recess in the sub-reflector with the under-surface of the sub-reflector extending outward beyond the distal end of the dielectric tube, said dielectric tube having a collar extended inward about its distal end;

an insert insertable into the dielectric tube to seat against the collar of the dielectric tube within the recess in the sub-reflector, said insert having an under-surface; and a fastener securing the insert against the collar of the dielectric tube within the recess of the sub-reflector, thereby securing the sub-reflector to the distal end of the dielectric tube, with the under-surface of the insert and the under-surface of the sub-reflector providing a substantially continuous reflective surface for the waveguide horn.

8. The antenna of claim 7 wherein the dielectric tube comprises ceramic.

9. The antenna of claim 7 wherein the dielectric tube comprises plastic.

10. The antenna of claim 7 wherein the fastener comprises a screw extending through the sub-reflector and engaging the insert.

11. The antenna of claim 7 wherein the dielectric tube further comprises a flange extending outward about its proximal end, and further comprising an annular ring fitting over the dielectric tube and engaging the flange to the distal end of the waveguide horn.

12. The antenna of claim 7 wherein the collar at the distal end of the dielectric tube is clamped between the insert and the sub-reflector.

* * * * *